US006152001A

United States Patent [19]

Faustmann

[11] Patent Number: 6,152,001

[45] **Date of Patent: *Nov. 28, 2000**

[54] PROCESS AND APPARATUS FOR THE PERFORATION OF SHEET MATERIAL PIECES

[76] Inventor: Heinz Faustmann, An der Heilquelle 29, D-63773 Goldbach, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/037,325

[22] Filed: Mar. 9, 1998

[30] Foreign Application Priority Data

Mar. 13, 1997 [DE] Germany ..... 197 10 350

[51] Int. Cl.[7] ..... B26F 1/24

[52] U.S. Cl. ..... 83/30; 83/434; 83/435.2

[58] Field of Search ..... 83/30, 422, 434, 83/435.2, 660

[56] References Cited

U.S. PATENT DOCUMENTS

| | | | |
|---|---|---|---|
| 2,127,960 | 8/1938 | Piazze . | |
| 3,053,291 | 9/1962 | Meissner et al. | 83/435 X |
| 3,119,295 | 1/1964 | Dryer . | |
| 3,214,502 | 10/1965 | Schaar . | |
| 3,451,358 | 6/1969 | Ruiz | 83/660 X |
| 4,060,017 | 11/1977 | Backlund | 83/23 |
| 4,075,917 | 2/1978 | Kistner et al. | 83/422 |
| 4,216,690 | 8/1980 | Bullock . | |
| 4,466,320 | 8/1984 | Tokuno et al. | 83/435.2 X |
| 4,589,316 | 5/1986 | Lang | 83/660 X |
| 4,653,366 | 3/1987 | Nichols et al. | 83/114 |
| 5,348,285 | 9/1994 | Huser | 271/183 |

FOREIGN PATENT DOCUMENTS

| | | |
|---|---|---|
| 0322697 | 7/1989 | European Pat. Off. . |
| 1009796 | 6/1952 | France . |
| 1479389 | 5/1969 | Germany . |
| 2204855 | 8/1973 | Germany . |
| 3935687 | 5/1991 | Germany . |
| 4201411 | 7/1993 | Germany . |
| 550057 | 6/1974 | Switzerland . |
| 0997683 | 7/1965 | United Kingdom . |

*Primary Examiner*—M. Rachuba
*Attorney, Agent, or Firm*—Fulbright & Jaworski, LLP

[57] ABSTRACT

In the perforation of sheet material including leather, artificial leather, foam, paper, filter paper, cardboard and foils by at least one group of spikes with perforating spikes, the individual pieces (9) of the sheet material are held on an endless conveyor device (2) and are pulled off the perforating spikes by a hold-down band (10*a*) which moves synchronously with the conveyor. It is especially advantageous that the at least one group of spikes is in each instance formed by a spike roller (7) and the hold-down band (10*a*) passes synchronously with the pieces (9) through the roller gap (8) of the at least one spike roller (7).

6 Claims, 2 Drawing Sheets

PROCESS AND APPARATUS FOR THE PERFORATION OF SHEET MATERIAL PIECES

Figure 1:
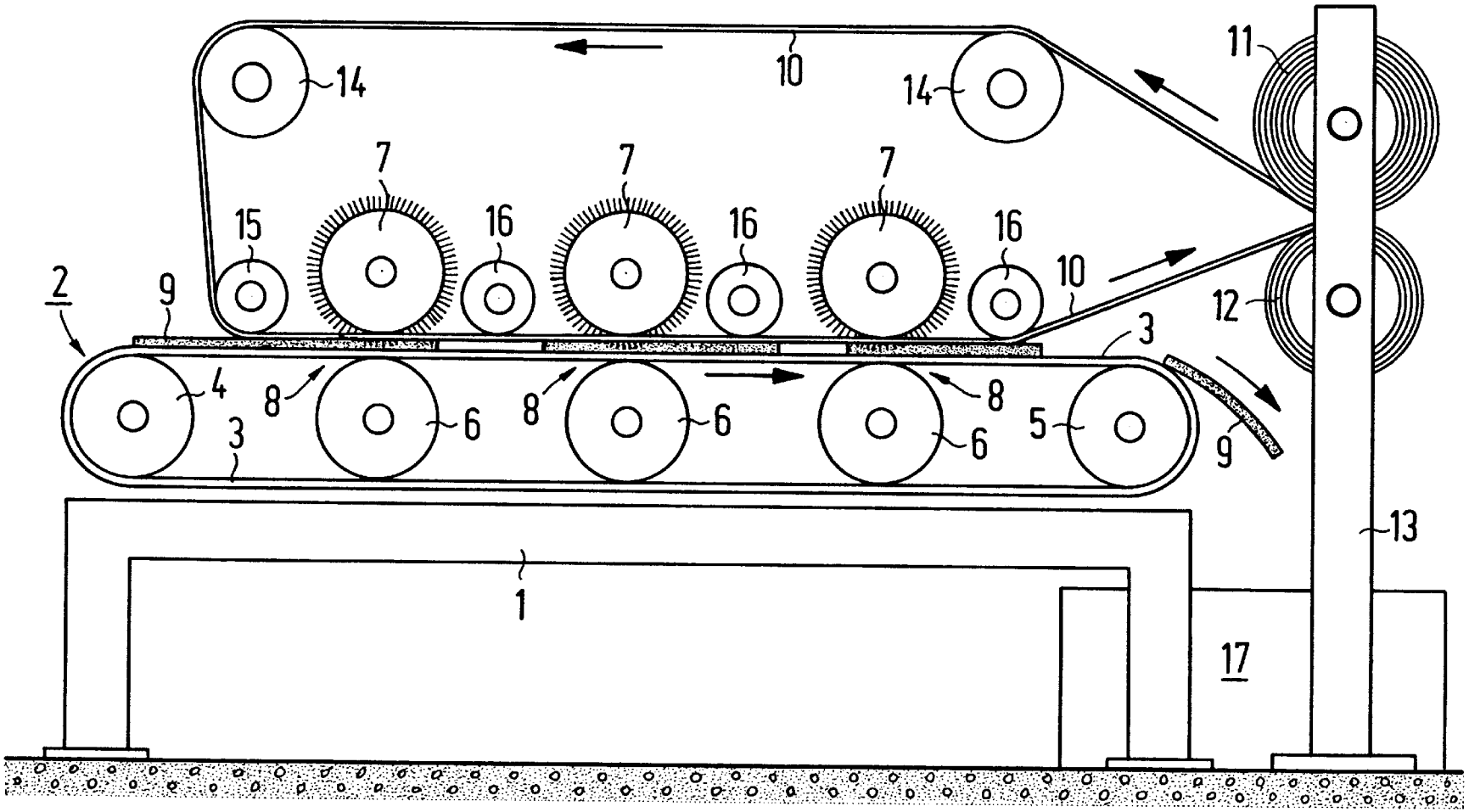

The invention concerns a process for the perforation of individual pieces of sheet material including leather, artificial leather, foam, paper, filter paper, cardboard and foils by at least one spike group with perforation spikes where the pieces are guided into the working zone of the at least one spike group by an endless transport device and are pulled off from the perforating spikes by at least one hold-down device.

Perforation processes are used to make sheet material permeable to either air or steam, i.e., to make them breathable, or for example to give a certain filtering characteristic to filter papers. Main applications are automobile seat covers, parts of shoes, gloves, articles of clothing and filter paper.

In a known process without a hold-down device the sheet material is guided in a stretched condition as an endless band through a roller gap between perforating rollers and support rollers. As the perforating rollers rotate, the perforating spikes penetrate into the stretched sheet material and the material is pulled away from the perforating spikes by being transported forward, i.e., by the tension of the band. However, this process fails when pieces of sheet material are not available in endless band form. Pieces of the material would roll up on the perforating rollers and this would shut down the process.

From U.S. Pat. No. 4,653,366, there is known perforation by a spiked roll of individual, regularly shaped, for example square pieces, where the pieces are first positioned precisely upon an endless transport band by two fixed flanges. In order to prevent the pieces of sheet material from rolling up on the spike roll, there are arranged between the spike roll and the sheet material positioned on the transport band, parallel steel bands of a certain length, fixed at each end and capable of being lifted and lowered with the spike roll by pressure drives. These bands cannot be penetrated by the spikes which has the disadvantage that the rows of spikes must be interrupted in the many locations corresponding to the steel bands, so that perforated areas of the sheet material alternate with non-perforated areas. Therefore the average density of the spikes and the perforations per surface unit is low and not sufficient for many applications. This known device is neither intended nor suitable for an evenly distributed perforation of sheet material pieces having irregular shapes because the spikes cannot be prevented from pulling up the edges of the material between the steel bands which can result in an obstruction of the apparatus.

From DE 42 01 411 A1 it is known to guide separate sheets of paper or such individually through a perforating station by means of two endless conveyor chains between which there are arranged grappling carriages, such that the sheets are thereafter passed, by means of an endless hold-down band, over a low-pressure suction box to be flattened before stacking. However, in this case the hold-down band is arranged between the sheets of paper and the cover wall of the suction box, in order to prevent the sheets from being pulled into the suction box. Therefore the hold-down band should more properly be called a "hold-up band." A spike roller is not present and neither is an endless band that is passed through the stamping station. No suggestions are provided for any additional embodiments of a perforating machine.

The object of the invention is therefore to make available a perforating process by which non-endless and odd-shaped or irregular sheet material pieces can be provided with evenly distributed perforations of high perforation density per surface unit, without a resulting blockage of the perforating process.

The above object is achieved according to the invention in that the sheet material pieces are held to the conveyor device by a hold-down band which is moved along with the conveyor device and through which the perforating spikes can pass.

Such a process can be especially advantageously used for leather and cuts of leather since by its nature this material only occurs in finite sizes. The process can be carried out in stationary manner, for example in a form of a stamping device, quasi-continuously and/or in step-wise cross transport, or continuously.

In a process where the at least one spike group is each formed by a spike roll, it is especially advantageous when the hold-down band runs synchronously with the sheet material pieces through the working zone and/or the roller gap of the at least one spike roll.

Such a hold-down band of a limited length can be drawn off a supply roll, be guided in a stretched condition through the roller gap between the at least one spike roller and the pieces being transported by the conveyor device and then be rolled up on a take-up roll for repeated, and especially multiple, use.

Alternatively it is possible to use up the hold-down band and for example to glue it to the sheet material pieces in order to make thin pieces of leather more resilient, whereupon this composite is again cut into individual pieces.

However, it is especially advantageous if the hold-down band is designed as an endless band and is passed multiple times at the transport speed through the working zone of the at least one spike roll, i.e., through the roller gap.

Material that can be used for such hold-down bands can be textile bands, especially woven bands, which exhibit a sufficient durability vis-à-vis the perforation spikes.

The invention also relates to a device for the perforation of sheet materials including leather, artificial leather, foam, paper, filter paper, cardboard and foils, having at least one transport device for the sheet material, at least one spike group with perforation spikes and at least one hold-down device arranged between the transport device and the spike group, which hold-down device pulls the individual sheet material pieces away from the perforating spikes.

To achieve the same objective, such a device is designed according to the invention such that the hold-down device is designed as a hold-down band which can pass synchronously with the sheet material pieces through the roller gap between the at least one spike roller and the transport device.

Such a device is also suitable as a universal device for providing endless material with evenly and densely distributed perforation holes, while in contrast, devices according to the prior art are not suitable for perforating sheet material pieces which are of irregular or unequal shapes. The invention makes it possible to easily achieve hole densities of up to 50 holes/cm$^2$ using only one spike roller with the appropriate number of spikes.

It is especially advantageous if the at least one spike group is formed by one spike roller and if the hold-down band runs synchronously with the sheet material pieces through the roller gap between the at least-one spike roller and the sheet material pieces located on the transport device, especially if the hold-down band is designed as an endless band.

The effect of the hold-down band is especially advantageous if one guide roller each is arranged before the first and behind the last spike roller whereby the guide roller holds the hold-down band on the sheet material pieces. By this means the angle of belt contact of the spike rolls is kept as small as possible and the hold-down band is protected from excessive wear.

Two embodiments of the invention are described below in more detail by way of FIGS. 1 and 2. There are shown, in side views, in FIG. 1, a device with a non-endless hold-down band, and in FIG. 2, a device analogous to FIG. 1, but with an endless hold-down band.

FIG. 1 shows a machine frame 1 on which is arranged a transport device 2 designed as an endless conveyor belt 3. The latter is guided over two deflection rollers 4 and 5 and three support rollers 6, and is made of stretch-resistant material of which at least the outer surface is soft and composed of for example a foam material, fleece or felt. Bearing brackets, drives and tensioning devices are not shown for the sake of simplicity.

One spike group each, designed as a spike roller 7, is arranged axially parallel over the support rollers 6. The number of the spike rollers is variable and depends on the desired density of perforations, which can be for example 150 holes/$cm^2$ behind the last spike roller 7.

A roller gap 8 is formed in each instance between the support rollers 6 andL the spike rollers 7 through which gap are passed the conveyor belt 3, the pieces 9 and the hold-down device designed as a hold-down band 10, in this order if viewed from below. This hold-down band 10 comes from the supply roll 11 and is again rolled up on a take-up roll 12, both rolls being mounted on a support frame 13. The hold-down band 10 and the deflection rollers 14 are kept under tension by a drive and a brake (both not shown).

In front of the first, and behind the last, spike roller 7, the hold-down band 10 is held, stretched downward and horizontally, to the pieces 9 by guide rollers 15 and 16 whereby the spikes naturally penetrate the hold-down band as well. The pieces 9 are placed on the conveyor on the left side, and when perforated, fall into a container 17.

Figure 2:
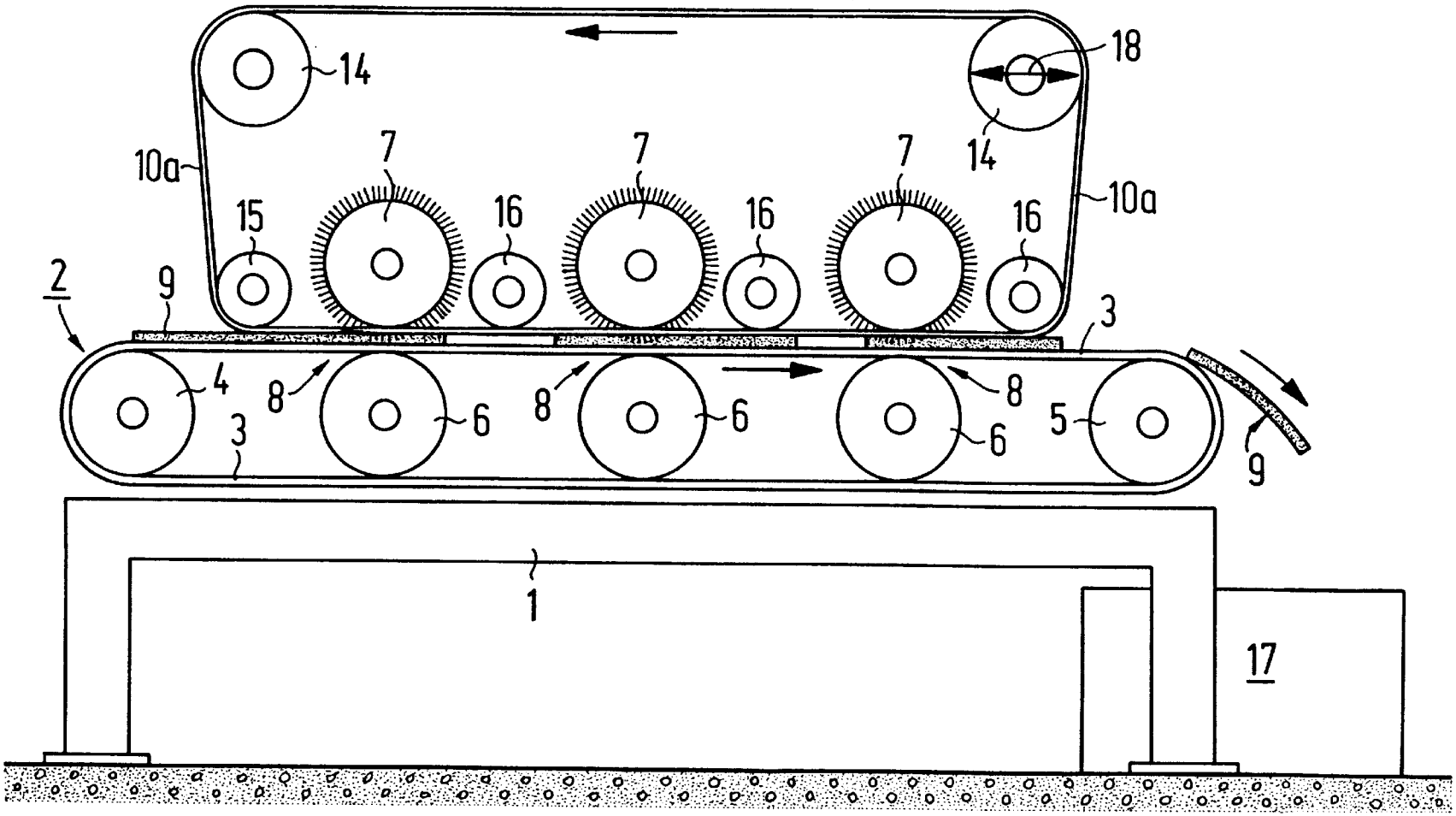

FIG. 2, in which the same reference numbering is used, differs from FIG. 1 in that an endless hold-down band 10*a* is used which band is kept stretched by the horizontal displacement of the right deflection roller 14 by a tensioning device 18, indicated by a double arrow. The relative thickness and length of the spikes as shown is exaggerated.

What is claimed is:

1. A process for perforating of individual pieces of sheet material comprising:

guiding the pieces of sheet material into the working zone of the at least one group of rotating spikes by an endless conveyor device;

holding the pieces of sheet material across the full sheet thereof to the conveyor device with a hold-down band made of a material through which the spikes can penetrate and which moves synchronously together with the conveyor device;

penetrating the sheet material and said hold-down band with said spikes; and pulling said pieces off the perforating spikes by at least one hold-down device.

2. A process according to claim 1, wherein the hold-down band is guided through the working zone of the at least one spike roller synchronously with the pieces.

3. A process according to claim 2, wherein the hold-down band is designed as an endless band and passes through the working zone of the at least one spike roller multiple times at the transport speed of the pieces.

4. An apparatus for perforating individual pieces of sheet material comprising:

a conveyor device for conveying sheet material;

at least one group of perforating spikes; and a hold-down band arranged between said conveyor device and said group of spikes to the individual pieces from the perforating spikes, the hold-down passing synchronously with the pieces through a roller gap between the at least one spike roller and the conveyor device, the hold-down band holding the sheet material on the full surface thereof and being made of a material through which said perforating spikes pass simultaneously when said spikes penetrate the sheet material.

5. An apparatus according to claim 4 wherein the hold-down band is an endless band.

6. An apparatus according to claim 4, wherein in front of the first and behind the last spike roller there are arranged guide rollers which keep the hold-down band on the pieces.

* * * * *